US007083053B2

(12) United States Patent
Campbell

(10) Patent No.: US 7,083,053 B2
(45) Date of Patent: Aug. 1, 2006

(54) SYSTEM FOR DISPLAYING WALLPAPER SAMPLES

(75) Inventor: Duncan F. Campbell, Inglewood (CA)

(73) Assignee: Wallcrown Limited, Rexdale (CA)

( * ) Notice: Subject to any disclaimer, the term of this patent is extended or adjusted under 35 U.S.C. 154(b) by 63 days.

(21) Appl. No.: 10/612,915

(22) Filed: Jul. 7, 2003

(65) Prior Publication Data

US 2005/0006327 A1 Jan. 13, 2005

(51) Int. Cl.
*B42F 1/00* (2006.01)

(52) U.S. Cl. ..... 211/55; 211/45; 211/85.26; 211/128.1

(58) Field of Classification Search ..... 211/45, 211/55, 13.1, 189, 44, 87.01, 86.01, 85.26, 211/128.1; 40/124.2; 206/730
See application file for complete search history.

(56) References Cited

U.S. PATENT DOCUMENTS

| | | | | |
|---|---|---|---|---|
| 3,138,261 | A * | 6/1964 | Witteborg | 211/41.1 |
| 3,871,524 | A | 3/1975 | Helf | |
| 3,986,756 | A | 10/1976 | Kranich | |
| 4,121,718 | A | 10/1978 | Bannister | |
| 4,175,807 | A | 11/1979 | Kranich et al. | |
| 4,265,038 | A | 5/1981 | Crosslen | |
| 4,331,245 | A * | 5/1982 | Schell | 211/45 |
| 4,433,883 | A | 2/1984 | Boender et al. | |
| 4,632,241 | A | 12/1986 | Brough et al. | |
| 4,905,845 | A * | 3/1990 | Broeker et al. | 211/55 |
| 4,925,038 | A * | 5/1990 | Gajewski | 211/59.2 |
| 4,936,468 | A * | 6/1990 | McNabb | 211/59.2 |
| 5,031,781 | A | 7/1991 | Price et al. | |
| 5,085,328 | A * | 2/1992 | Evenson | 211/55 |
| D327,189 | S | 6/1992 | McPherson et al. | |
| 5,328,037 | A * | 7/1994 | Fujii | 211/55 |
| 5,676,249 | A | 10/1997 | DeProspero | |
| 5,806,688 | A * | 9/1998 | Adenau et al. | 211/47 |
| 5,855,480 | A | 1/1999 | Housman | |
| 5,915,571 | A | 6/1999 | Czalkiewicz et al. | |
| 5,931,301 | A * | 8/1999 | Hadden et al. | 206/449 |
| 6,006,927 | A | 12/1999 | Levy | |

(Continued)

FOREIGN PATENT DOCUMENTS

| | | |
|---|---|---|
| EP | 0 213 782 | 3/1987 |

(Continued)

OTHER PUBLICATIONS

Imperial Gallery Retail Marketing System Brochure, 1997.

*Primary Examiner*—Jennifer E. Novosad
(74) *Attorney, Agent, or Firm*—Bereskin & Parr

(57) ABSTRACT

A display system for displaying samples of wallpaper includes a display stand having a frame and at least one panel, a plurality of wallpaper display samples affixed to the at least one panel in a pre-selected pattern, a plurality of pre-cut wallpaper samples correlated with the display samples and a plurality of containers sized and shaped for removably holding the pre-cut samples. The pre-cut samples are sized to be substantially smaller than the display samples, and each of the containers is secured to the at least one panel in front of a pre-selected portion of one of the display samples so that a significant portion of the display sample is exposed for visual and tactile examination. The display stand may include four upstanding members which are arranged at approximately ninety-degree intervals about a notional central axis and which project outwardly from that axis, and which each have at least two substantially oppositely faced mounting surfaces on which wallpaper samples may be displayed.

20 Claims, 9 Drawing Sheets

U.S. PATENT DOCUMENTS 6,068,139 A 5/2000 Brozak, Jr.
6,416,612 B1 * 7/2002 Lerner et al. ..... 156/277
6,427,853 B1 8/2002 Brozak, Jr.
6,530,485 B1 * 3/2003 Weber ..... 211/55
6,533,130 B1 * 3/2003 Padiak et al. ..... 211/50
6,578,718 B1 * 6/2003 Levy ..... 211/50

FOREIGN PATENT DOCUMENTS

GB 2182845 * 5/1987
WO WO 02/094551 A1 11/2002

* cited by examiner

SYSTEM FOR DISPLAYING WALLPAPER SAMPLES

FIELD OF THE INVENTION

The present invention relates to systems for the sale of wallpaper, and more particularly, to display systems for the retail sale of special order wallpaper.

BACKGROUND OF THE INVENTION

Wallpaper is conventionally sold at the retail level by means of fixtures which both display samples of the wallpaper and store a supply of wallpaper for purchase by consumers. A typical fixture consists of a series of cubicles sized for holding rolls of wallpaper, having a front cover to which is affixed a display sample of the wallpaper contained in the cubicle. One example of such a fixture is described in U.S. Pat. No. 4,433,883 to Boender et al. The use of this type of display stand fixture requires the retailer to maintain a substantial inventory of wallpaper, which is disadvantageous, because of the additional costs associated with this inventory.

Another problem with retailing wallpaper through the use of conventional display/storage fixtures is that they often do not include take home samples, which results either in customers opening rolls to rip off small pieces, or, in an effort to avoid such a problem, the retailer making a roll of each type of wallpaper available to the consumer so that they can remove pieces to take home.

It is therefore desirable to provide a system for facilitating the sale of "special order" wallpaper utilizing take-home samples, which obviates the aforementioned disadvantages.

There exist some fixtures which include means for displaying take-home samples. U.S. Pat. No. 6,068,139 to Brozak, Jr. discloses a display and storage rack for rolled media, such as wallpaper. This rack may include a fin having a plurality of wallpaper display samples positioned behind clear plastic, with take home samples of wallpaper for the consumer's use located in pockets positioned behind the display sample. The wallpaper display samples found at a given height in the fin correspond to the rolled media stored at that height on that side of the fin. Brozak Jr. also discloses the use of a rotatable carousel having flexible, concave display panels for wallpaper. U.S. Pat. No. 5,031,781 to Price et al. discloses a display rack for wall coverings having plurality of angularly inclined, overlapping, removable shelves on which wallpaper may be displayed, and also has vertical support columns having pockets in which take-home pieces of the displayed wallpaper may be placed. One disadvantage of this design is that a customer, when looking at the display as a whole, can only view "the outer-most edge of each wallcovering sample". Even though the design of Price et al. permits either the shelf or the wallpaper sample to be removed, overall comparisons between samples may be difficult because (except for the top sample) only part of each sample is exposed to view. An additional disadvantage of the Price et al. patent is that the pockets for the take-home pieces are positioned on the support columns, such that a customer may not be immediately able to associate the appropriate take home piece with its corresponding sample.

Furthermore, all of the above retail display fixtures suffer from the same disadvantage, namely, when wallpaper is placed in any of the above display stands a consumer is not able to assess both the look and texture of the wallpaper in the condition in which it is actually used; i.e. affixed to a surface, and then immediately access a co-located, corresponding take home sample. Seeing the appearance and feeling the texture of the wallpaper when affixed to a flat surface may assist consumers in determining whether that wallpaper is truly appropriate to their purpose. Once they have made that assessment, they should immediately be able to access a take home sample without having to look for it.

An additional disadvantage of the above retail display fixtures is that they create an inherent limit in the number of persons who can simultaneously view and inspect the wallpaper samples up close. Although not all consumers looking at a given wallpaper display unit will wish to look at the same display samples, the generally linear structure allows only a few people to stand in front of a given sample array at any time.

Accordingly, it is desirable to provide a wallpaper display system which includes wallpaper display samples that are exposed for both visual and tactile examination, and which further includes provision for associated take home samples that are co-located with the display samples. Additionally, it is desirable to provide a display stand for displaying wallpaper that permits a significant portion of each display sample of wallpaper to be viewed at the same time as other display samples. It is further desirable to provide a display stand for displaying wallpaper that permits a greater number of people to simultaneously view the wallpaper samples.

SUMMARY OF THE INVENTION

The present invention is directed to a display system for displaying samples of wallpaper, comprising a display stand having a frame and at least one panel secured to the frame, the at least one panel having a front surface, a plurality of wallpaper display samples affixed to the front surface of the at least one panel in a pre-selected pattern, a plurality of pre-cut wallpaper take home samples correlated with the display samples, wherein the take home samples are sized to be substantially smaller than the display samples, and a plurality of containers sized and shaped for removably holding a supply of the take-home samples, wherein each of the containers is secured to the at least one panel in front of a pre-selected portion of one of the display samples so as to expose a significant portion of the display sample for visual and tactile examination.

The present invention is also directed to a display stand for displaying samples of wallpaper, comprising a free standing frame having four upstanding members arranged at approximately ninety-degree intervals about a vertical central axis, each of said upstanding members projecting outwardly from the vertical central axis, each of said upstanding members having at least two substantially oppositely faced mounting surfaces on which wallpaper display samples may be displayed.

DETAILED DESCRIPTION OF THE INVENTION

Figure 1:
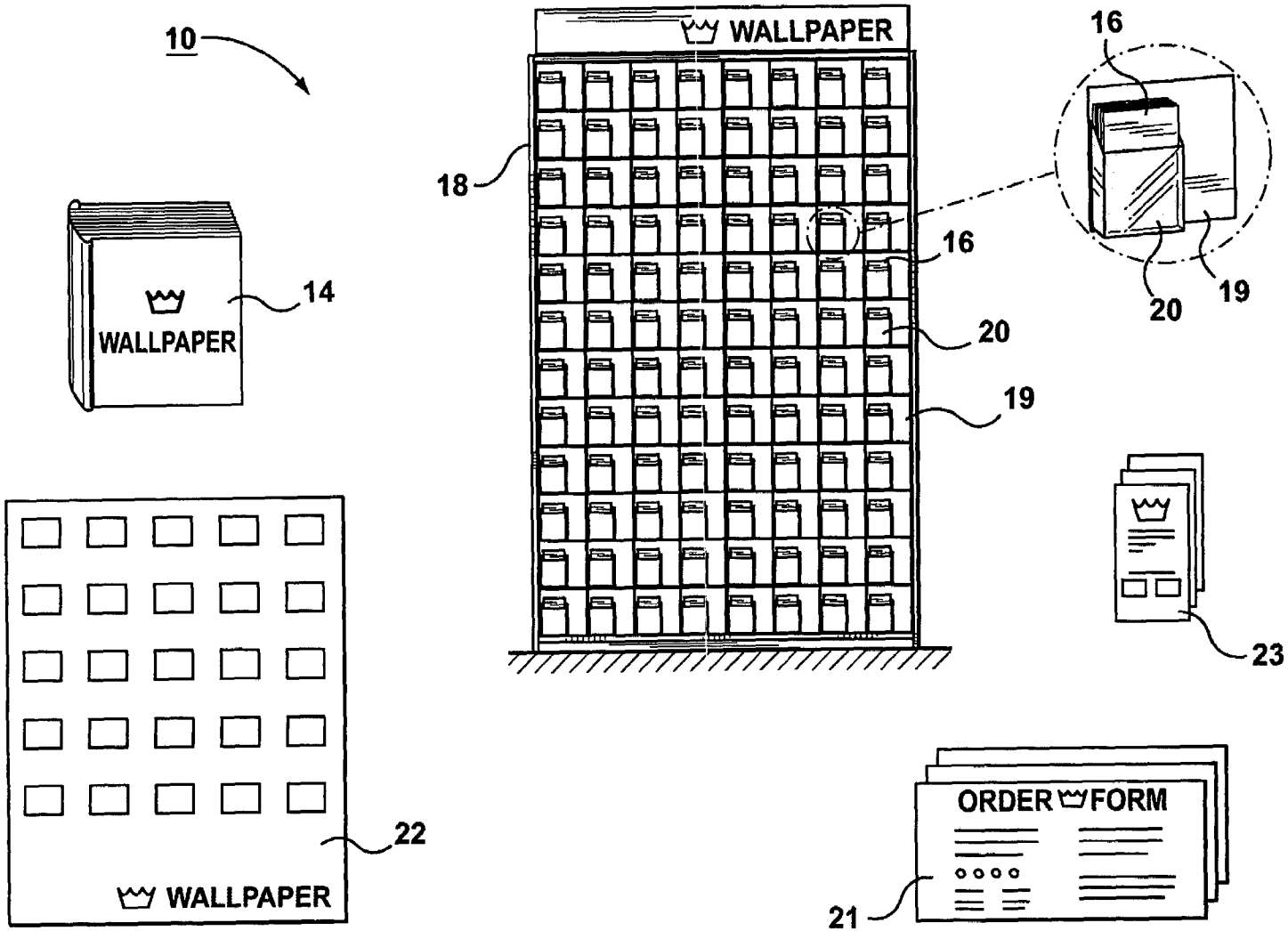
FIG. 1 is a schematic diagram of a system for facilitating the sale of wallpaper.

Referring to FIG. 1, there is shown a schematic diagram of a system 10 for facilitating the sale of wallpaper in accordance with the subject invention. System 10 comprises a plurality of pre-cut take home samples of wallpaper 16, a display stand 18 for displaying a plurality of wallpaper display samples 19 and for holding a plurality of containers 20 for containing a supply of the pre-cut take home samples 16. Wallpaper take home samples 16 are correlated with the wallpaper display samples 19 and are sized to be substantially smaller than the wallpaper display samples 19. Each container 20 is secured in front of a pre-selected portion of one of the wallpaper display samples 19.

The system 10 may also comprise a sample book 14, a plurality of order forms 21 suitable for recording an order for wallpaper by a customer, a poster 22 and a plurality of brochures 23. Each order form 21 provides for ordering of wallpaper matching samples of wallpaper contained in the sample book 14 or matching wallpaper that comprises the pre-cut take home samples 16. The samples of wallpaper contained in sample book 14 correspond to pre-cut take home samples 16, such that for selected samples of wallpaper illustrated within sample book 14, there is a plurality of corresponding pre-cut take home samples 16. Poster 22 shows various styles of wallpaper, and brochures 23, which may be placed in a special holder (not shown) mounted on display stand 18, can provide additional information. It will be noted that sample book 14, poster 22 and brochures 23 are optional components of system 10, and that system 10 will operate in the absence of any or all of them.

Referring now to FIGS. 2–6, illustrated therein is a first embodiment of a display stand 18 for displaying wallpaper display samples 19 In accordance with the present invention. The wallpaper display stand 18 comprises a frame 24 and at a plurality of transversely extending panels 26 secured to frame 24. Panels 26 each have a generally vertically extending front surface 28 to which a plurality of wallpaper display samples 19 are affixed in a pre-selected pattern. In the embodiment shown, each panel 26 carries eight wallpaper display samples 19. Panels 26 are preferably constructed from fiberboard.

Wallpaper display stand 18 further comprises a plurality of containers 20 sized and shaped for removably holding pre-cut wallpaper take home samples 16. Each of the containers 20 is secured to the at least one panel 26 in front of a pre-selected portion of one of the wallpaper display samples 19 so that a substantial portion of each wallpaper display sample 19 is exposed for visual and tactile examination.

The wallpaper display stand 18 of the present invention permits the advantageous organization of wallpaper samples. For wallpaper having a dominant color and a shade, it is possible to arrange wallpaper display samples 19 along panels 26, and to further arrange panels 26 on frame 24, in a pattern organized by the dominant color and shade of wallpaper display samples 19. Organizing wallpaper display samples 19 and panels 26 in such a way may make it easier for consumers to compare similar shades of the same dominant color of wallpaper, and may also make it easier for a consumer to find a particular color or shade of wallpaper.

Figure 2:
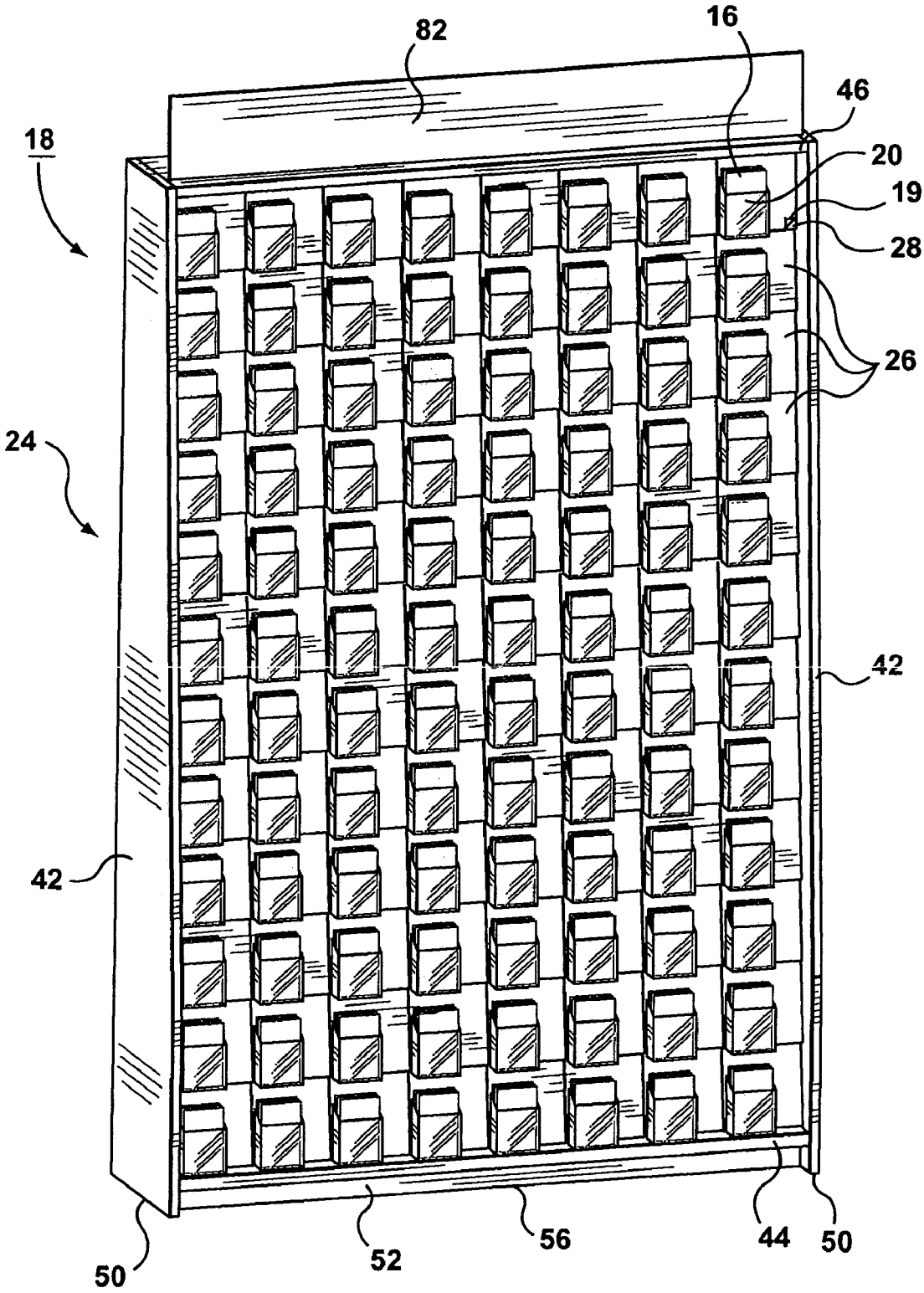
FIG. 2 is a perspective view of a first embodiment of a wallpaper display stand according to the present invention.
Figure 4:
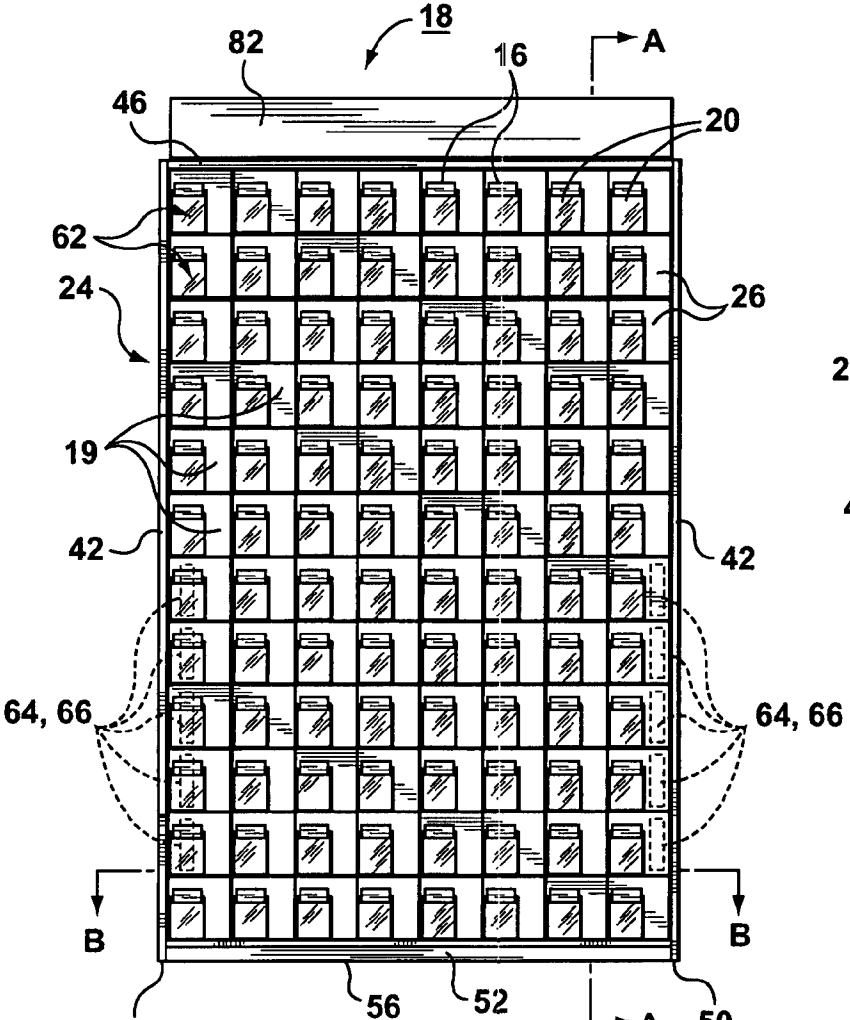
FIG. 4 is a front view of a first embodiment of a wallpaper display stand according to the present invention

As best shown in FIGS. 2 and 4, wallpaper display samples 19 are preferably arranged in a grid comprising rows and columns (each panel 26 comprising a single row, with each wallpaper display sample 19 comprising a cell). This permits the application of numerous methods for organizing wallpaper display samples 19 and panels 26 according to the dominant color and shade of associated wallpaper display sample 19. For example, the rows may be organized according to shade, and the columns organized according to dominant color. Thus, the grid may be arranged such that the shade of each of the wallpaper display samples 19 in any row below the top row is darker than the shade of the wallpaper display sample 19 above, and such that the dominant color of each wallpaper display sample 19 in a given column corresponds generally to a visible color band on a natural rainbow, with each column representing a single such color band. In other words, each column would represent a single color, and the shades of each color would become darker from the top to the bottom of the grid. Alternatively, the same organization could be used, but with the shade of each of the wallpaper display samples 19 in any row above the bottom row being darker than the shade of the wallpaper display sample 19 below, such that the shades of each color would become lighter from the top to the bottom of the grid. Regardless of whether the rows are oriented so that the shade becomes darker from top to bottom or from bottom to top, the columns could then be arranged in the same order as the colors they represent would appear in a natural rainbow.

Alternatively, the columns may be organized according to shade, and the rows organized according to dominant color. Thus, the grid may be arranged such that the shade of each of the wallpaper display samples 19 in any column to the right of the leftmost column is darker than the shade of the wallpaper display sample 19 to its left, and such that the dominant color of each wallpaper display sample 19 in a given row corresponds generally to a visible color band on a natural rainbow, with each row representing a single such color band. Thus, the shades of each color would become lighter from the left to the right of the grid. Alternatively, the same organization could be used, but with the shade of each of the wallpaper display samples 19 in any column to the left of the rightmost column darker than the shade of the wallpaper display sample 19 to its right, such that the shades of each color would become lighter from the right to the left of the grid. Again, regardless of whether the columns are oriented so that the shade becomes darker from left to right or from right to left, the rows could then be arranged in the same order as the colors they represent would appear in a natural rainbow.

Figure 5:
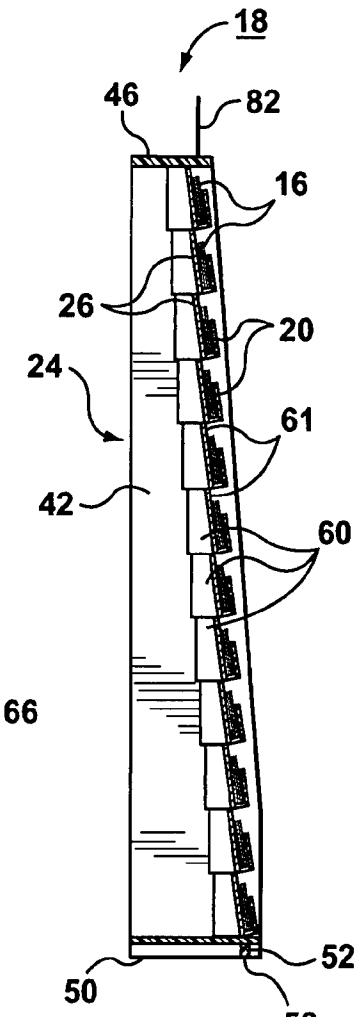
FIG. 5 is a side sectional view taken along line A—A of a first embodiment of a wallpaper display stand according to the present invention.
Figure 3:
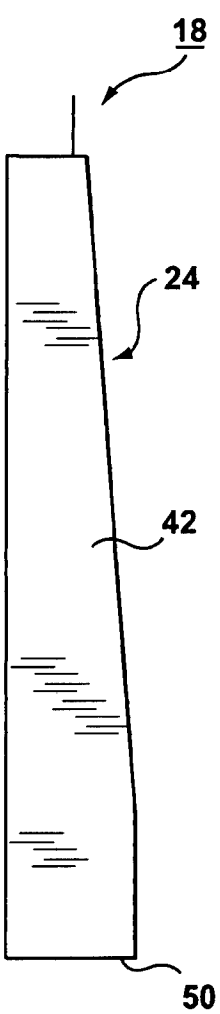
FIG. 3 is a side view of a first embodiment of a wallpaper display stand according to the present invention.

Now referring to FIGS. 3, 4 and 5, frame 24 of wallpaper display stand 18 has two side columns 42, a bottom member 44 and top member 46. Although frame 24 may optionally include a back (not shown), it will be appreciated that a back is not required either to maintain the mechanical integrity of frame 24 or even for appearance when two display stands 18 are placed back to back, or one display stand 18 is placed against a wall.

Each of bottom member 44 and top member 46 are secured to side columns 42. Each side column 42 has a bottom edge 50. Additionally, front support member 52 is secured between side columns 42, and to bottom member 44. Front support member 52 is disposed towards the front of frame 24, and has bottom edge 56. In the embodiment shown, when frame 24 is placed on a floor it will rest on bottom edge 58 of back support member 54, bottom edges 50 of side columns 42, and bottom edge 56 of front support member 52. Thus, bottom edges 58, 50 and 56 together comprise a flat bottom portion for placing wallpaper display stand 18 on a floor. Alternatively, wallpaper display stand 18 may be made suitable for resting on a floor by means of other base structures, for example a single flat base (not shown). Frame 24 is preferably composed of wood, but may also be constructed of plastic or any other suitable rigid material, or from a combination of materials.

Figure 6:
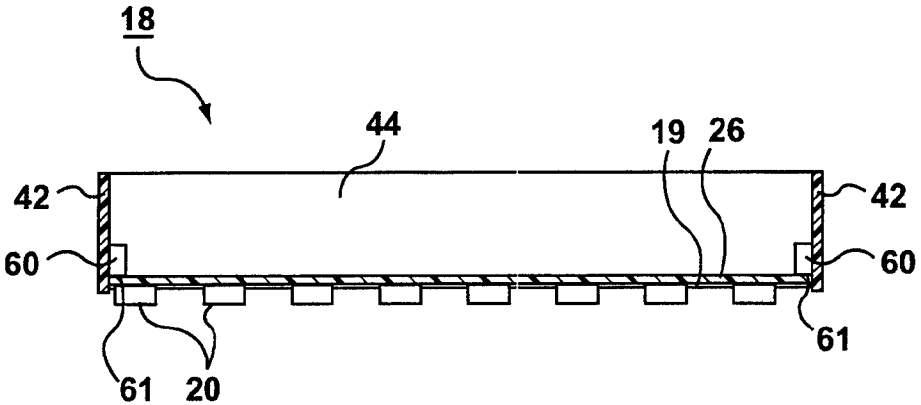
FIG. 6 is a sectional view taken along line B—B of a first embodiment of a wallpaper display stand according to the present invention.

As shown in FIGS. 5 and 6, panels 26 are secured to frame 24 by means of a plurality of mounting blocks 60 extending from the interior surfaces of side columns 42 to provide a surface 61 on which ends 62 of panels 26 can be mounted. Because panels 26 are rigid, mounting blocks 60 need only project far enough to permit ends 62 of panels 26 to be firmly secured thereto to enable each panel 26 to withstand substantial pressure applied to its center (i.e. well in excess of the pressure that would be applied by a person examining the texture of wallpaper).

Panels 26 are preferably removably secured to mounting blocks 60 by way of securing means such as Velcro strips 64, 66 affixed to ends 62 of panels 26 and to front surfaces 61 of mounting blocks 60, respectively, although other securing means for removably securing panels 26 could also be used. Removably securing panels 26 to frame 24 allows panels 26 (and thereby the wallpaper samples 19 displayed thereon) to be easily changed without replacing the entirely of wallpaper display stand 18. Alternatively, panels 26 may be permanently secured to mounting blocks 60, for example by use of securing means such as of glue, screws or nails. It will be noted that front surface 61 of mounting blocks 60 is inclined slightly away from vertical, so that when panels 26 are secured thereto, they will face slightly upward. This slight angle improves the visibility of wallpaper displayed on panels 26. It will be noted, however, that while panels 26 may face slightly upward, the angle of incline away from vertical is no more than 5 to 10 degrees, such that front surface 28 of panel 26 is still considered to be generally vertically extending.

Figure 7:
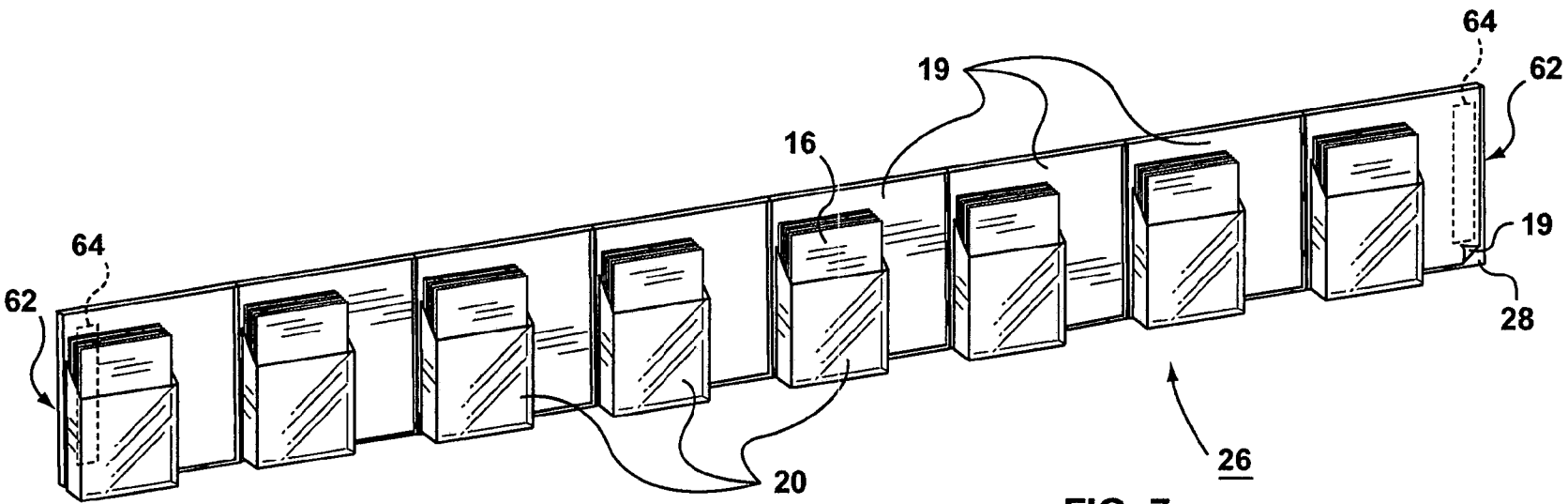
FIG. 7 is a perspective view of a panel for a first embodiment of a wallpaper display stand according to the present invention.

Referring now to FIG. 7, there is shown a preferred embodiment of one of the panels 26. Panel 26 has a front surface 28 to which a plurality of wallpaper display samples 19 are affixed. Each wallpaper display sample 19 comprises a piece of wallpaper intended to serve as a sample of a particular type, color and style of wallpaper, and, of course, will have a texture. Wallpaper display samples 19 are affixed to front surface 28 of panel 26 by way of wallpaper paste or the like (i.e. in the same manner in which that type of wallpaper would be affixed to a wall) so as to form a row of individual squares or rectangles of wallpaper along panel 26.

Still referring to FIG. 7, it can be seen that each container 20 is substantially smaller than its associated wallpaper display sample 19 so that a significant portion of the wallpaper display sample 19 is exposed for visual and tactile examination by a consumer. In other words, a consumer will be able to examine the appearance and texture of the wallpaper represented by wallpaper display sample 19 when it is affixed to a wall as it would be when "in use". Preferably, more than 50% of the surface of wallpaper display sample 19 is exposed for visual and tactile examination.

Figure 8:
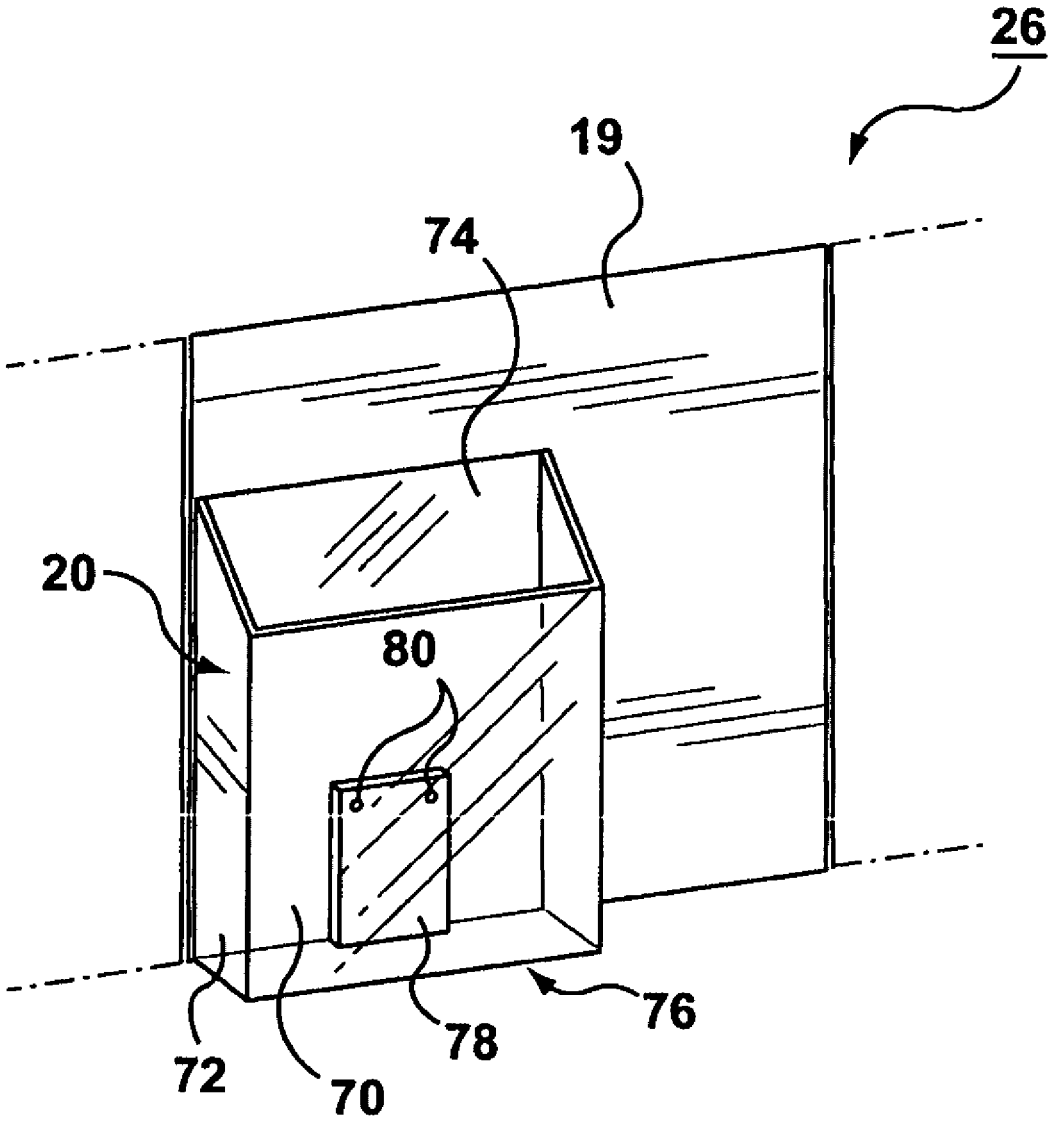
FIG. 8 is a perspective view of a container for use with a wallpaper display stand according to the present invention.

Now referring to FIG. 8, a more detailed view of an embodiment of one of the containers 20 is shown. Preferably, container 20 comprises an open-topped, rectangular box, which can removably hold a supply of pre-cut wallpaper take home samples 16 (not shown in FIG. 8). This permits a consumer to take a pre-cut take home sample 16 away with him or her to compare it to the decor in his or her home or other location where the wallpaper is to be installed. It will be appreciated by one skilled in the art that container 20 may have any desired shape, so long as it remains shaped for removably holding pre-cut take home samples 16.

In a preferred embodiment, each container 20 has a front wall 70, two side walls 72, a back wall 74 and a bottom 76. The containers 20 are preferably secured to panels 26 directly (e.g. by nails, screws or staples), but may also be secured indirectly (e.g. by being secured to wallpaper display samples 19 which are in turn secured to panel 26). For containers 20 to be secured to panel 26, it is not necessary that the container 20 be in contact with front surface 28 or the wallpaper display sample 19 affixed thereto. All that is required is that containers 20 be somehow secured to panel 26 such that they are maintained in a position directly in front of front surface 28 (and therefore also in front of one of the wallpaper display samples 19 affixed thereto). In attaching containers 20 to panels 26 using fasteners such as staples, nails, or the like, greater strength of attachment can be achieved by placing a fiberboard retention piece 78 on the inside of container 20 adjacent back wall 74 and securing fasteners 80 through retention piece 78 and into panel 26 so that the back wall 74 of container 20 is sandwiched between retention piece 78 and panel 26.

Preferably, container 20 is composed of a flexible and transparent material such as acrylic. This will permit a consumer to see through container 20 to the pre-cut take home samples 16, which, of course, are preferably the same type and color of wallpaper as the wallpaper display sample 19 associated with that container 20. Container 20 allows the wallpaper display sample 19 and the supply of matching pre-cut take home samples 16 to be co-located, in the sense that the supply of take home samples is located within the perimeter of a display sample 19 having the same pattern and color. In addition to eliminating the need to search for the take home samples 16, this configuration also maintains continuity of appearance so that the combination of wallpaper display sample 19, container 20 and pre-cut take home samples 16 may be seen as embodying a single square or rectangle of wallpaper. Alternatively, containers 20 may be constructed of an opaque material, in which case a similar effect could be achieved by overlaying the opaque material with wallpaper of the same type and color of wallpaper as the wallpaper display sample 19 associated with that container 20. Furthermore, the effect may be maintained even when container 20 is empty by placing a layer of matching wallpaper (not shown) over fiberboard retention piece 78.

A sign 82 can be affixed to the top portion 46 of frame 24 of the wallpaper display stand 18. This sign 82 can be used to identify the trademark of the store or wallpaper supplier, and may also be used to provide consumer information.

Figure 9:
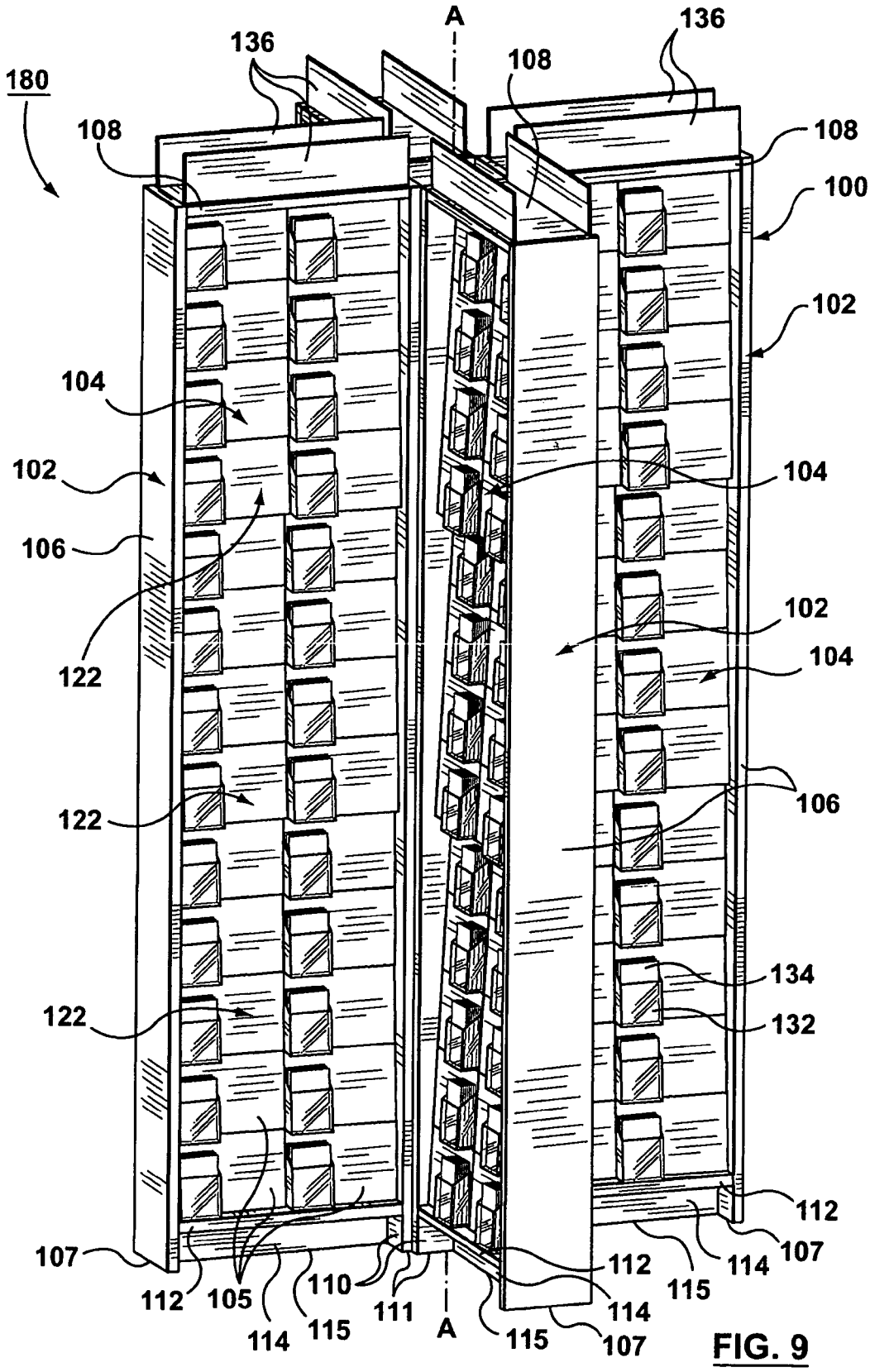
FIG. 9 is a perspective view of a second embodiment of a wallpaper display stand according to the present invention.
Figure 10:
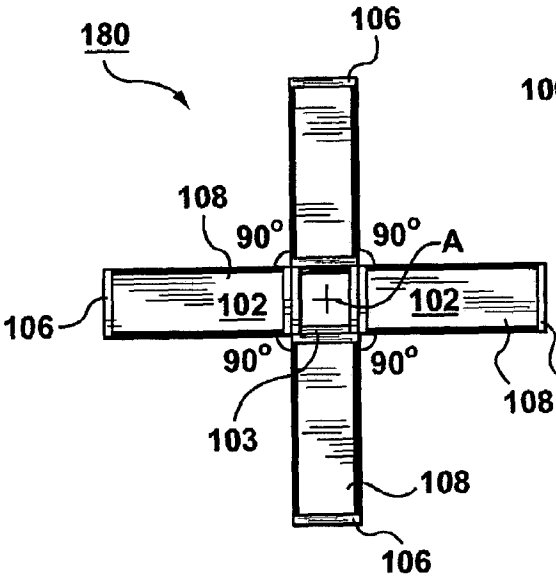
FIG. 10 is a plan view of a second embodiment of a wallpaper display stand according to the present invention.

Referring now to FIGS. 9 to 13, illustrated therein is a second embodiment of a wallpaper display stand made in accordance with the subject invention, shown generally as 180. Wallpaper display stand 180 is suitable for resting on a floor, and comprises a frame 100 having four upstanding members 102. Referring in particular to FIGS. 9 and 10, upstanding members 102 are arranged at approximately ninety-degree intervals about a notional central axis denoted by A, said notional central axis A being perpendicular to the floor on which wallpaper display stand 180 rests. Each upstanding member 102 projects outward from notional central axis A so as to form a generally cross-shaped structure when viewed from above. Wallpaper display stand 180 may also have a square central column 103, centered about notional central axis A, to which each upstanding member 102 is secured. Square central column 103 is preferred, but is not strictly necessary, as the upstanding members 102 may alternatively be secured to each other. Each upstanding member 102 also has at least two substantially oppositely faced mounting surfaces 104 on which wallpaper display samples 105 may be displayed, for a total of at least eight oppositely faced mounting surfaces on wallpaper display stand 180.

One advantage of the generally cross-shaped configuration of wallpaper display stand 180 is that it provides increased stability for a stand-alone display, in that it is less likely to topple if accidentally (or deliberately) pushed. An additional advantage is that it permits up to four persons to easily view different samples of wallpaper simultaneously (i.e. one person standing between two upstanding members 102).

Figure 11:
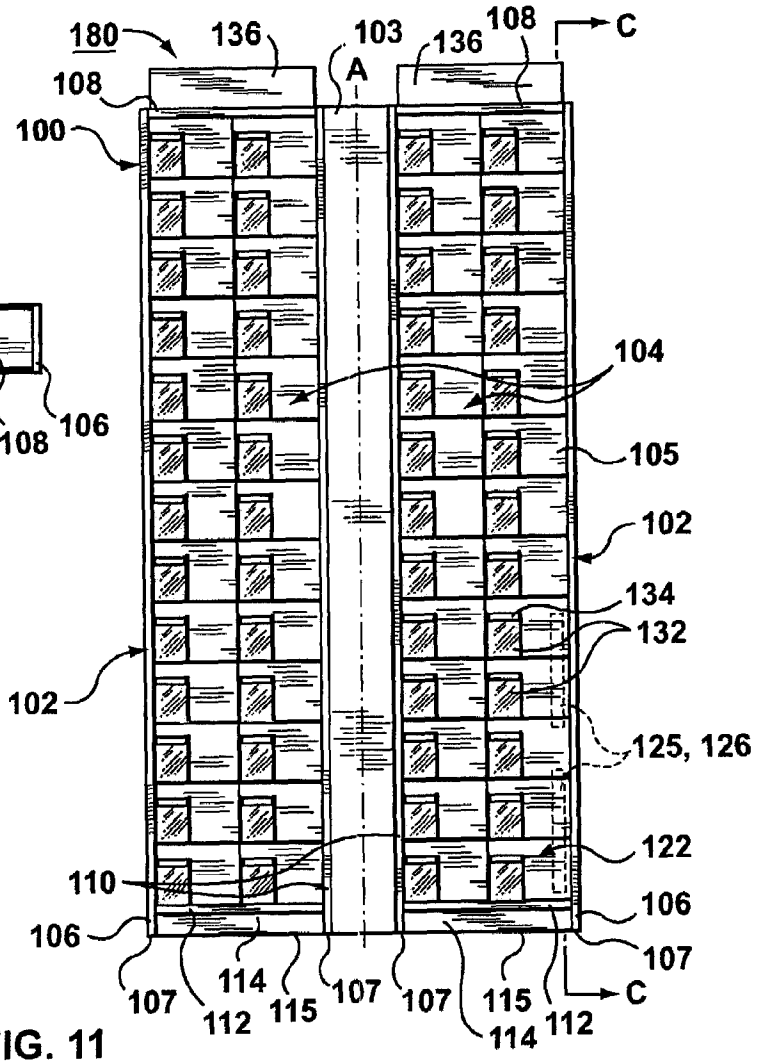
FIG. 11 is a front view of a second embodiment of a wallpaper display stand according to the present invention.

Additionally, it will be appreciated by one skilled in the art that the various methods for organizing wallpaper display samples 19 according to their dominant color and shade (described above with respect to the first embodiment 18 of a wallpaper display stand) are adaptable to the second embodiment 180 of a wallpaper display stand. Referring now to FIG. 11, in the embodiment shown the substantially oppositely faced mounting surfaces 104 of upstanding members 102 can each accommodate two columns of wallpaper display samples 105. Accordingly, the columns cannot be arranged directly in a single series to match the order of colors in a natural rainbow. However, if each column represents a single color (with shade either increasing or decreasing by row from top to bottom), these colors can still be organized into rational pairs. For example, blue could be paired with purple, yellow with green, and red with orange. Other methods of organizing the colors of wallpaper display samples 105 will be readily apparent to those skilled in the art. Given that in the embodiment shown, each single side arrangement of mounting surfaces 104 can accommodate two columns of wallpaper display samples 105, it would not be preferred to segregate colors by row rather than by column.

Still referring to FIG. 11, in the embodiment shown each upstanding member 102 has an outer side column 106 having a bottom edge 107, a top member 108, an inner side column 110 having a bottom edge 111, as well as a bottom member 112. Top member 108 and bottom member 112 are each secured to outer side column 106 and inner side column 110. Each upstanding member 102 also has a lower cross-member 114 having bottom edge 115, cross-member 114 being secured to each of outer side column 106, inner side column 110 and bottom member 112. When placed on a floor, wallpaper display stand 180 rests on bottom edge 115 of cross-member 114 and on bottom edges 107 and 111 of inner side column 106 and outer side column 110, respectively. Thus, the combination of all four sets of bottom edges 107, 111 and 115 of each upstanding member 102 together make frame 100 free standing so that wallpaper display stand 180 may rest on a floor. It will of course be appreciated that other structural configurations may be used to provide a flat bottom portion to make frame 100 free standing while still maintaining the generally cross-shaped structure of the present invention.

Figure 12:
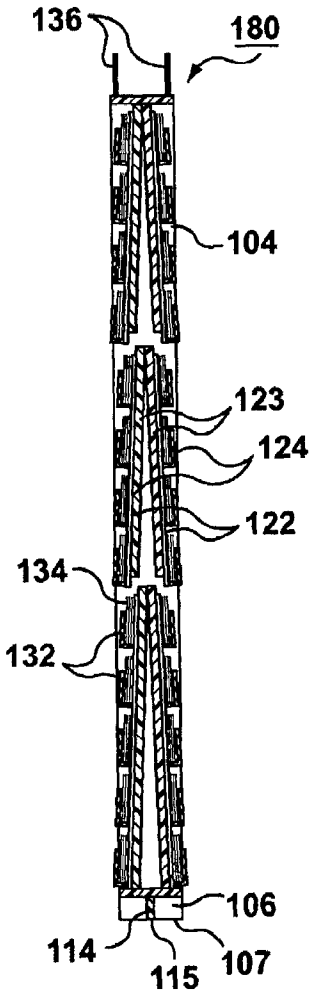
FIG. 12 is a side sectional view taken along line C—C of an upstanding member in a second embodiment of a wallpaper display stand according to the present invention.

As noted above, each upstanding member 102 has at least two substantially oppositely faced mounting surfaces 104 on which wallpaper display samples 105 may be displayed. Still referring to FIG. 11, it can be seen that the oppositely faced mounting surfaces 104 are located between inner side column 110 and outer side column 106 of each upstanding member 102. As shown in FIG. 12, in a preferred embodiment, mounting surfaces 104 are the generally vertically extending front surfaces 104 of panels 122. In particular, in the preferred embodiment shown in FIG. 12, a total of six panels 122 (comprising three sets of two substantially oppositely faced mounting surfaces 104) are provided for each upstanding member 102.

Figure 13:
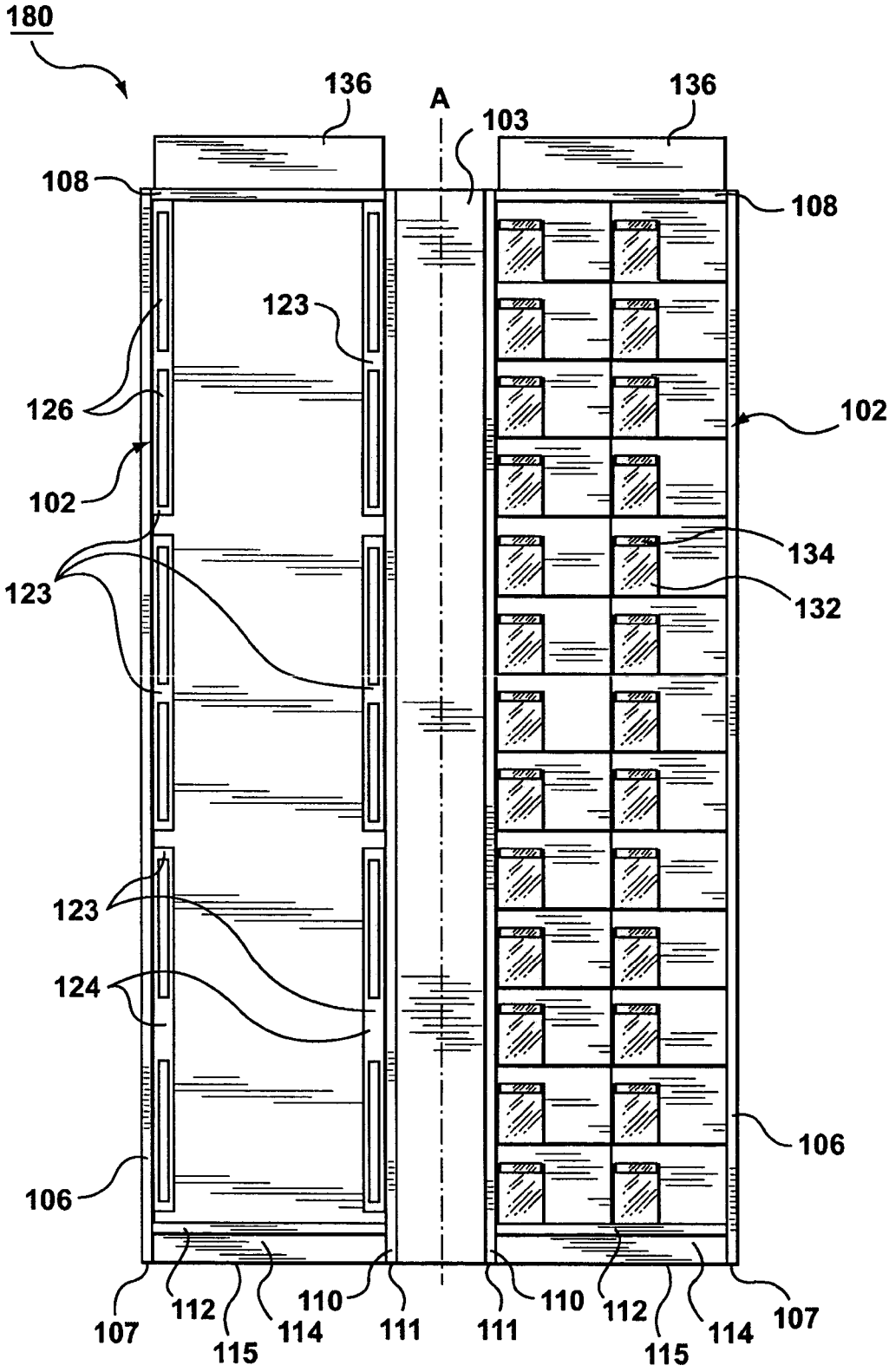
FIG. 13 is a partial cut-away front view of a second embodiment of a wallpaper display stand according to the present invention.

Panels 122 are secured to mounting members 123, which are in turn secured to the inside walls of outer side column 106 and inner side column 110 of each upstanding member 102. Referring now to FIG. 13, a front partial cut-away view of the second embodiment 180 of the present invention is shown. Mounting members 123 project inwardly from outer side column 106 and inner side column 110 to provide surfaces 124 on which the edges of a panel 122 can be mounted. Panels 122 are constructed of a rigid material, such as fiberboard, so that mounting members 123 need only project far enough to permit the ends 127 of panels 122 to be firmly secured thereto. The generally vertically extending front surfaces 104 of panels 122 then become the front face of the wallpaper display stand 180. Similarly to first embodiment 18, panels 122 are preferably removably secured to mounting members 123 by way of securing means such as Velcro strips 125, 126 affixed to ends 127 of panels 122 and to front surfaces 124 mounting members 123, respectively. Removably securing panels 122 allows panels 122 (and thereby the wallpaper displayed thereon) to be easily changed without replacing the entirely of wallpaper display stand 180. It will be noted that, as with mounting blocks 60 in first embodiment 18, front surfaces 124 of mounting members 123 are inclined slightly away from vertical, so that when panels 122 are secured thereto, they will face slightly upward. This slight angle improves visibility of wallpaper displayed on panels 122 of wallpaper display unit 180.

Figure 14:
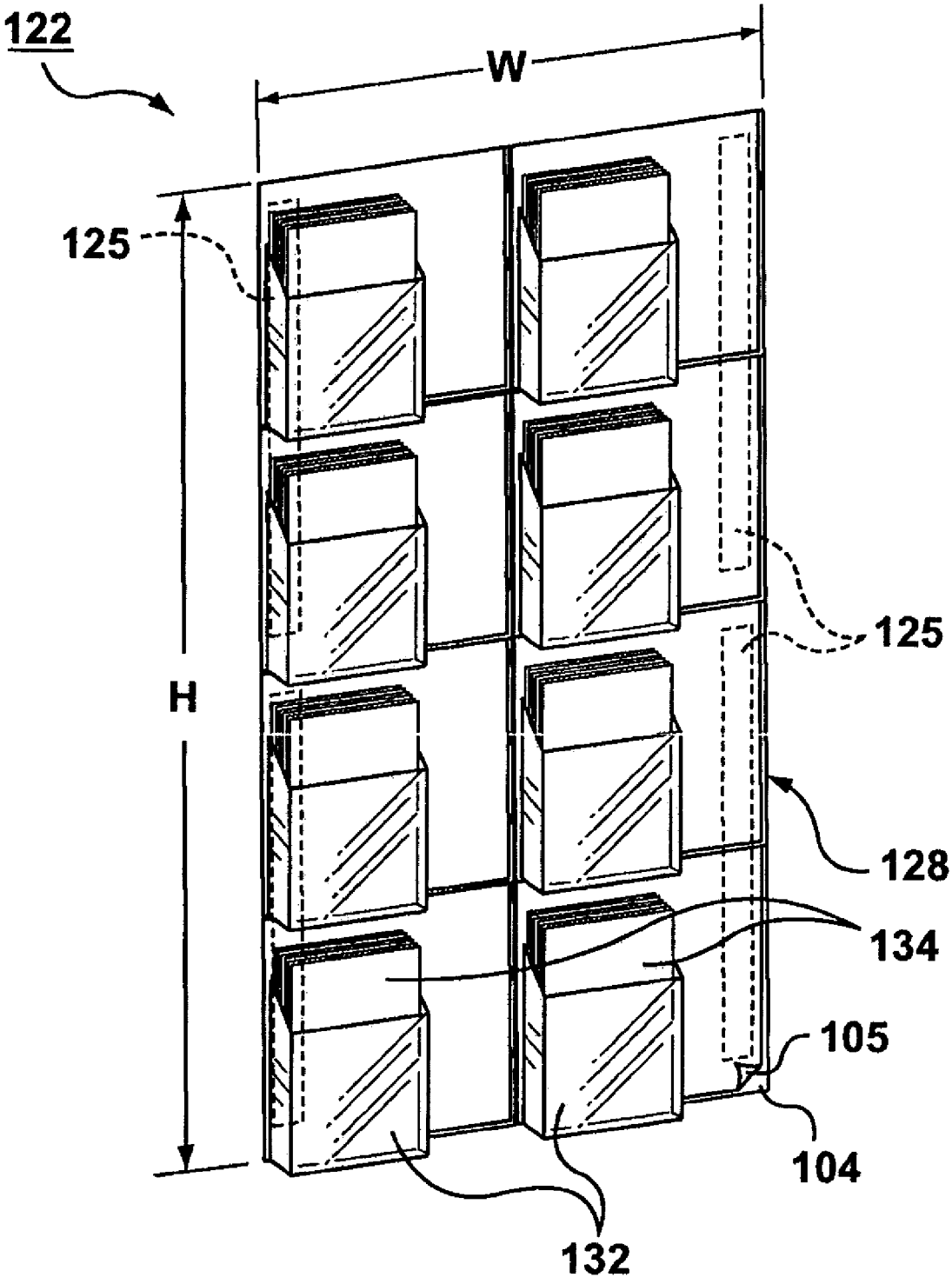
FIG. 14 is a perspective view of a panel for a second embodiment of a wallpaper display stand according to the present invention.

Referring now to FIG. 14, there is shown an embodiment of a panel 122 for use with display stand 180. Panels 122 are of a design analogous to panels 26 in first embodiment 18, but are shaped differently to accommodate the different structure of second embodiment 180. In particular, in the embodiment shown panels 122 comprise a rectangular section having a height H that is generally between 1.2 and 1.6 times its width W. It should be understood that-other embodiments of panels 122 of the present invention may have dimensions outside this range.

Similarly to panel 26, each panel 122 has a front surface 104, which comprises a mounting surface 104 to which a plurality of wallpaper display samples 105 are affixed. As with wallpaper display sample 19 in first embodiment 18, each wallpaper display sample 105 comprises a piece of wallpaper that has a texture, and is affixed to mounting surface 104 of panel 122 in the same manner in which that type of wallpaper would be affixed to a wall, forming an array of individual square or rectangular samples.

Now referring to FIG. 11 as well as FIG. 14, there are shown a plurality of containers 132 shaped for removably holding pre-cut take home samples 134 of wallpaper. As with first embodiment 18, pre-cut take home samples 134 are correlated with wallpaper display samples 105. The containers 132 are preferably of the same design and construction as those described in first embodiment 18, and are likewise affixed to panels 122 either directly or indirectly. As with containers 20 described for first embodiment 18, greater strength of attachment is achieved through the use of a fiberboard retention piece (as shown in FIG. 8 for first embodiment 18). The configuration of containers 132 is similar to that described for containers 20 in relation to first embodiment 18, with one container 132 secured in front of a pre-selected portion of one of the wallpaper display samples 105 on panel 122, each container 132 being substantially smaller than its associated wallpaper display sample 105. Thus, a significant portion of wallpaper display sample 105 is exposed for visual and tactile examination. Again, this significant portion is preferably greater than 50 percent of wallpaper display sample 105.

As can be seen in FIG. 12, while the mounting surfaces 104 provided by panels 122 are substantially oppositely facing, they need not be precisely parallel to each other. Thus, the generally vertically extending surfaces 104 of panels 122 which comprise mounting surfaces 104 need not be precisely vertical, and in fact in a preferred embodiment panels 122 are inclined slightly (i.e. preferably no more than about 5 to 20 degrees) away from vertical, so that panels 122 face slightly upward. While the preferred embodiment has three sets of substantially oppositely faced mounting surfaces 104 for each upstanding member 102, the present invention requires only one set of two substantially oppositely faced mounting surfaces 104 for each upstanding member 102. Such a configuration could (for example) comprise two larger panels 122 secured to a single set of mounting members 123, which would in turn be secured to outer side column 106 and inner side column 110 and would run from top member 108 to bottom member 112 of upstanding member 102 (this embodiment is not shown). Thus, display stand 180 could have eight panels 122, with each upstanding member 102 having two sets of mounting member 123 for receiving the eight panels 122 in a configuration wherein at two panels are mounted on each upstanding member 122 in a substantially oppositely faced configuration.

In a manner similar to that described for the first embodiment 18, a sign 136 may be secured to top portion 108 of upstanding member 102.

In an alternative embodiment of display stand 18 (not shown), frame 24 may include a single panel 26 such that its front surface 28 comprises the entire front face of the wallpaper display stand 18. Thus, while a preferred embodiment of wallpaper display stand 18 comprises a plurality of panels, a wallpaper display stand 18 having only a single panel 26 is still contemplated within the scope of the invention.

One skilled in the art will recognize that a frame for a wallpaper display stand of the present invention could easily be adapted to be mounted on a wall. Furthermore, it will be recognized that a frame for a wallpaper display stand of the present invention could in fact comprise a wall of a retail establishment in which the wallpaper display stand is placed, although this is not preferred as it makes removal or modification of such a display difficult.

While the present invention has been described with respect to a number of preferred embodiments, it should be understood that various modifications and adaptations of the preferred embodiments are possible without departure from the present invention, the scope of which is defined in the appended claims.

The invention claimed is:

1. A wallpaper display system, comprising:

(a) a display stand having a frame and at least one panel secured to the frame, the at least one panel having a front surface;

(b) a plurality of wallpaper display samples affixed to the front surface of the at least one panel in a pre-selected pattern, wherein each of the display samples comprises a piece of wallpaper having a front surface with a selected appearance and texture, and wherein the pattern is selected to expose all of the front surface of each of the display samples for display;

(c) a plurality of pre-cut wallpaper take home samples, wherein each of the take home samples is correlated with one of the display samples, wherein the take home samples are sized to be substantially smaller than the display samples; and (d) a plurality of containers sized and shaped for removably holding a supply of the take home samples, wherein each of the containers is secured to the at least one panel in front of a pre-selected portion of one of the display samples so that a significant portion of each of the display samples remains exposed for visual and tactile examination.

2. The display system of claim 1, wherein the front surface is generally vertically extending.

3. The display system of claim 1, wherein the significant portion of the display sample comprises at least fifty percent of the display sample.

4. The display system of claim 1, wherein the at least one panel comprises securing means for removably securing the panel to said frame.

5. The display system of claim 1, wherein said containers are composed of a transparent material.

6. The display system of claim 1, wherein said at least one panel comprises a plurality of transversely extending panels, the panels having generally vertically extending front surfaces.

7. The display system of claim 1, wherein the pattern is selected to arrange said wallpaper display samples in a grid comprised of columns and rows and wherein each wallpaper display sample has a dominant color.

8. The display system of claim 7, wherein each wallpaper display sample has a dominant color and wherein the pattern is selected so that the dominant color of each wallpaper display sample in a given column or row corresponds generally to a visible color band on a natural rainbow, each of said columns or rows representing a single such color band.

9. The display system of claim 8, wherein each wallpaper display sample has a shade and wherein the pattern is selected to arrange the samples in progressively darker shades in a given column or row.

10. The display system of claim 1, wherein each of the wallpaper display samples has a dominant color and a shade, and wherein the pattern is selected to organize the wallpaper display samples according to said dominant color and said shade.

11. The display system of claim 1, wherein (a) the at least one panel comprises at least eight panels;

(b) the frame is free standing and comprises four upstanding members arranged at approximately ninety-degree intervals about a vertically extending notional central axis, each of said upstanding members projecting outwardly from said notional central axis, and;

(c) each of said upstanding members has at least two sets of mounting members for receiving said at least eight panels in a configuration wherein at least two panels are mounted on each upstanding member in a substantially oppositely faced configuration.

12. The display system of claim 1, further comprising a sample book.

13. The display system of claim 1, further comprising a plurality of order forms.

14. The display system of claim 1, further comprising a plurality of brochures, and a holder attached to the frame for holding the brochures.

15. A wallpaper display system, comprising:

(a) a display stand having a frame and at least one panel secured to the frame, the at least one panel having a front surface;

(b) a plurality of wallpaper display samples affixed for display to the front surface of the at least one panel in a pre-selected pattern such that substantially all of each of the display samples is exposed for display;

(c) a plurality of pre-cut wallpaper take home samples wherein each of the take home samples is correlated with one of the display samples; and (d) a plurality of containers sized and shaped for removably holding a supply of the take home samples, wherein each of the containers is secured to the frame in close proximity to one of the display samples so as to visually associate the supply of take home samples therein with the display sample correlated therewith, the containers being sized and located so that at least a significant portion of each of the display samples remains exposed for visual and tactile examination.

16. The display system of claim 15, wherein the front surface is generally vertically extending.

17. The display system of claim 15, wherein the pattern is selected to arrange said wallpaper display samples in a grid of columns and rows.

18. The display system of claim 15, wherein the frame is free standing and comprises four upstanding members arranged at approximately ninety-degree intervals about a vertically extending notional central axis, each of said upstanding members projecting outwardly from said notional central axis, each of said upstanding members having at least two substantially oppositely faced display surfaces for displaying the wallpaper display samples.

19. The display system of claim 15, wherein the take home samples are sized to be substantially smaller than the display samples.

20. A wallpaper display system, comprising:

(a) a display stand having a frame with a vertically extending mounting surface;

(b) a plurality of wallpaper display samples affixed to the mounting surface in a pre-selected pattern;

(c) a plurality of pre-cut wall paper take home samples correlated with the display samples; and (d) a plurality of containing devices sized and shaped for removably holding a supply of the take home samples, wherein the containing devices are mounted onto the frame so as to present the take home samples in a generally vertically extendinq fashion, each of the containing devices being located proximate to one of the display samples so as to visually associate the supply of take home samples contained therein with the display samples correlated therewith.

* * * * *